US011261713B2

(12) United States Patent
Zahran

(10) Patent No.: US 11,261,713 B2
(45) Date of Patent: Mar. 1, 2022

(54) JETTING PLUNGER FOR PLUNGER LIFT APPLICATIONS

(71) Applicant: Saudi Arabian Oil Company, Dhahran (SA)

(72) Inventor: Amr Mohamed Zahran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/880,596

(22) Filed: May 21, 2020

(65) Prior Publication Data

US 2021/0363865 A1 Nov. 25, 2021

(51) Int. Cl.

| | |
|---|---|
| ***E21B 43/12*** | (2006.01) |
| ***E21B 33/068*** | (2006.01) |
| ***E21B 34/06*** | (2006.01) |
| ***E21B 47/12*** | (2012.01) |
| ***F04B 47/12*** | (2006.01) |

(52) U.S. Cl.

CPC ..... *E21B 43/122* (2013.01); *E21B 33/068* (2013.01); *E21B 34/06* (2013.01); *F04B 47/12* (2013.01)

(58) Field of Classification Search

CPC ..... E21B 43/122; E21B 43/13; E21B 43/12; E21B 43/121; E21B 43/123; E21B 33/068; E21B 34/06; F04B 47/12

See application file for complete search history.

(56) References Cited

U.S. PATENT DOCUMENTS

| | | | | |
|---|---|---|---|---|
| 2,038,426 A | | 4/1936 | Fletcher | |
| 2,577,210 A | * | 12/1951 | Ruska | E21B 49/082 166/64 |
| 2,762,308 A | | 9/1956 | Tomlinson | |
| 4,211,279 A | | 7/1980 | Isaacks | |
| 4,596,516 A | * | 6/1986 | Scott | E21B 34/066 166/265 |
| 5,472,054 A | * | 12/1995 | Hinds | E21B 34/10 166/106 |
| 6,148,923 A | | 11/2000 | Casey | |
| 6,705,404 B2 | | 3/2004 | Bosley | |
| 6,830,108 B2 | | 12/2004 | Rogers, Jr. et al. | |
| 6,966,366 B2 | | 11/2005 | Rogers, Jr. et al. | |
| 7,080,692 B1 | | 7/2006 | Kegin | |
| 7,188,670 B2 | | 3/2007 | Amies et al. | |

(Continued)

FOREIGN PATENT DOCUMENTS

| | | | |
|---|---|---|---|
| CN | 109209305 | | 1/2019 |
| CN | 109209305 A | * | 1/2019 |

OTHER PUBLICATIONS

PCT International Search Report and Written Opinion in International Appln. No. PCT/US2021/033488, dated Sep. 6, 2021, 13 pages.

*Primary Examiner* — George S Gray

(74) *Attorney, Agent, or Firm* — Fish & Richardson P.C.

(57) ABSTRACT

An unloading plunger having an internal chamber to hold compressed gas and a timer-operated valve to release the compressed gas through a gas jetting port as a jetting force for ascent of the unloading plunger in a wellbore to unload liquid from a well. The ascending of the unloading plunger may be via a combined motive force of wellbore pressure provided by formation pressure plus the jetting force provided by ejecting the compressed gas from the unloading plunger.

26 Claims, 3 Drawing Sheets

(56) References Cited

U.S. PATENT DOCUMENTS

| | | | | |
|---|---|---|---|---|
| 7,337,854 | B2 | 3/2008 | Horn et al. | |
| 8,181,706 | B2 | 5/2012 | Tanton | |
| 8,893,777 | B1 | 11/2014 | Garrett | |
| 8,985,221 | B2 | 3/2015 | Mazzanti | |
| 9,206,676 | B2 | 12/2015 | Quigley et al. | |
| 9,322,251 | B2 | 4/2016 | Mazzanti | |
| 2002/0162662 | A1* | 11/2002 | Passamaneck | E21B 43/121 166/370 |
| 2008/0135239 | A1* | 6/2008 | Edwards | E21B 49/084 166/264 |
| 2008/0210429 | A1* | 9/2008 | McMillin | E21B 33/13 166/313 |
| 2009/0038788 | A1 | 2/2009 | Farris | |
| 2012/0318524 | A1* | 12/2012 | Lea, Jr. | E21B 34/02 166/372 |
| 2013/0319661 | A1* | 12/2013 | Xiao | E21B 43/121 166/250.03 |
| 2015/0275633 | A1* | 10/2015 | Tolman | E21B 43/122 166/253.1 |
| 2017/0044883 | A1* | 2/2017 | Wilkinson | E21B 43/121 |
| 2020/0141214 | A1 | 5/2020 | Kuykendall | |

* cited by examiner

300

JETTING PLUNGER FOR PLUNGER LIFT APPLICATIONS

TECHNICAL FIELD

This disclosure relates to employing plunger lift to unload a well.

BACKGROUND

Plunger lift is an artificial lift mechanism for high gas-liquid ratio (GLR) oil wells and for gas well deliquification. The plunger lift may utilize a solid plunger or flow-through plunger to act as interface between wellbore fluids to facilitate utilizing wellbore pressure to produce the well. The plunger lift may be implemented with no external power source to the plunger. Plunger lift generally relies on reservoir natural energy to lift accumulated liquids from the wellbore to unload a liquid-loaded well so that the well may produce hydrocarbon from the reservoir. However, once the reservoir energy ceases to cycle the plunger naturally, another lifting mechanism should be considered. In startup and commissioning cases, swabbing or coiled-tubing intervention may be considered to kick off the well and then for the plunger lift to operate.

A well may be unloaded by removing a column of kill fluid from the wellbore to initiate flow from the subterranean formation (reservoir). Practices for unloading a well may include circulation of lower density fluid, nitrogen lifting, swabbing, plunger lift, and so on. The selection of the technique employed may depend on the well completion design, reservoir characteristics, and other factors. Plunger lift is an artificial lift technique for unloading a well that utilizes well energy of formation pressure to cycle a plunger (e.g., traveling piston) up the tubing or casing of a well. The plunger may serve as a solid interface between the liquid above the plunger and the fluid (e.g., primarily gas) below the plunger. The fluid below the plunger may supply the energy (via formation pressure) to propel the plunger (and the liquid slug above the plunger) to the Earth surface. Once the plunger is at the surface, the well may produce hydrocarbon from the subterranean formation. Then, when a column of liquid again accumulates in the wellbore, the well (wellbore) may be shut in to facilitate (allow) the plunger to drop back to bottom. Another plunger-lift cycle may begin once the well has built up sufficient pressure. Cycle frequency may vary with each well and type of production.

SUMMARY

An aspect relates to an unloading plunger to unload liquid from a well. The unloading plunger includes a body to interface with an inside surface of production tubing in a wellbore to provide a seal in the production tubing between above the unloading plunger and below the unloading plunger. The unloading plunger includes an internal chamber to hold compressed gas. The internal chamber has a chamber inlet to receive the compressed gas into the internal chamber and a chamber outlet to release the compressed gas from the internal chamber. The unloading chamber has a gas jetting port in the body at a bottom portion of the unloading plunger to receive the compressed gas from the internal chamber through the chamber outlet and discharge the compressed gas from the unloading plunger to below the unloading plunger as a jetting force for the unloading plunger. The unloading plunger includes a timer-operated valve disposed at the chamber outlet to prevent flow of the compressed gas through the chamber outlet when the timer-operated valve is closed and to provide release of the compressed gas through the chamber outlet from the internal chamber when the timer-operated valve is open.

Another aspect relates to a method of operating a well, including descending an unloading plunger from a rest position at a wellhead into production tubing to below liquid in the production tubing in a bottom portion of a wellbore. The unloading plunger has an internal chamber having compressed gas. The method includes ejecting the compressed gas from the internal chamber into the production tubing below the unloading plunger to provide motive force for ascent of the unloading plunger through the production tubing from the bottom portion of the wellbore to the wellhead. The method includes ascending the unloading plunger through the production tubing from the bottom portion of the wellbore to the rest position at the wellhead via a combined motive force of a first motive force that wellbore pressure provided by formation pressure and a second motive force that is the motive force provided by ejecting the compressed gas. The method includes unloading the liquid above the unloading plunger in the production tubing via the ascending of the unloading plunger.

The details of one or more implementations are set forth in the accompanying drawings and the description below. Other features and advantages will be apparent from the description and drawings, and from the claims.

DETAILED DESCRIPTION

Figure 1:
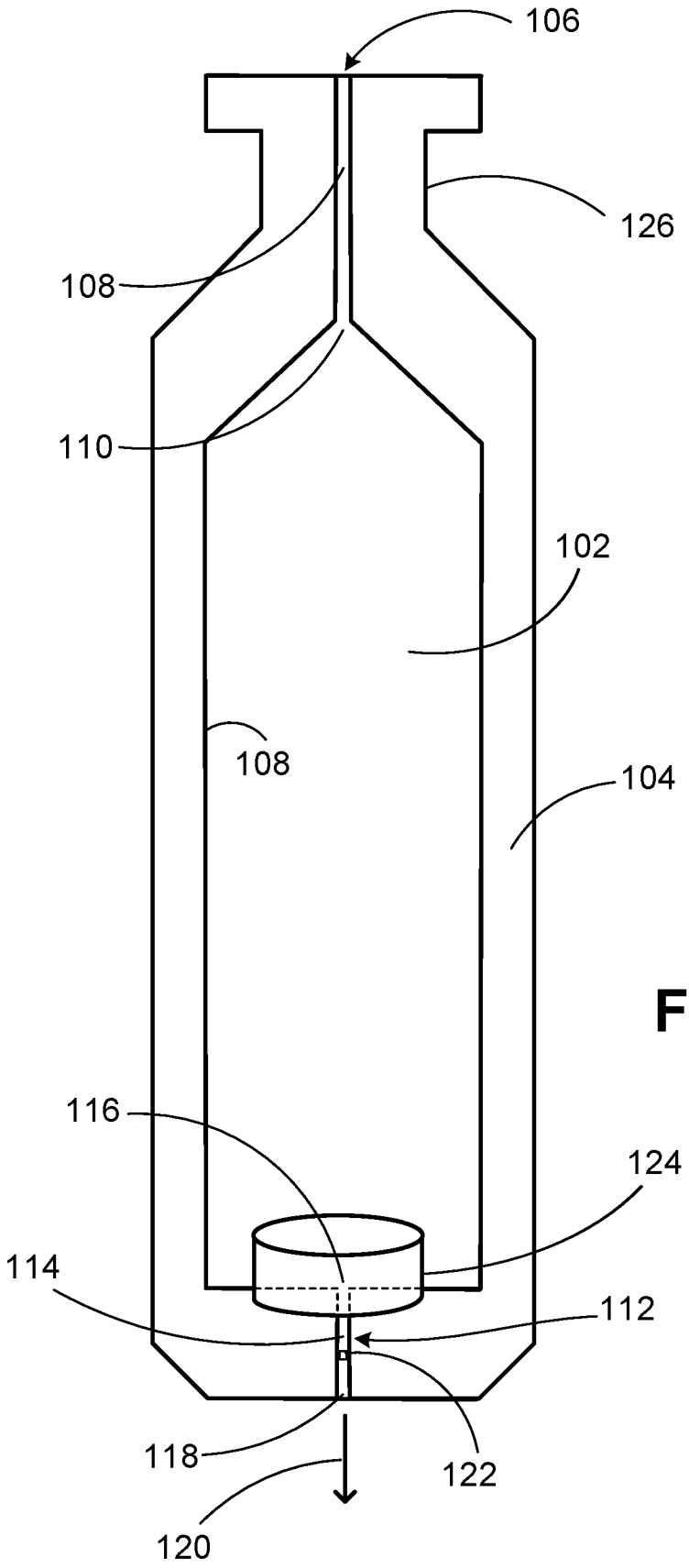
FIG. 1 is a diagram of an unloading plunger to be utilized in plunger lift applications for gas wells, oil and gas wells, and oil wells.

Some aspects of the present disclosure are directed to an unloading plunger having an internal chamber to hold compressed gas. The unloading plunger has a timer-operated valve to release the compressed gas through a gas jetting port as a jetting force for ascent of the unloading plunger in a wellbore to unload liquid from a well. The gas jetting port is on a bottom portion of the unloading plunger. The compressed gas is discharged to below the unloading plunger. The ascending of the unloading plunger may be via a combined motive force of wellbore pressure provided by formation pressure plus the jetting force provided by ejecting the compressed gas from the unloading plunger.

Plunger lift is an artificial-lift alternative applied to gas and oil wells typically having high gas-liquid ratio (GLR). Plunger lift may be an artificial-lift technique principally utilized in gas wells to unload liquid (e.g., condensate, water, etc.). However, plunger lift is also applied to oil wells with high GLR and oil wells without high GLR. Plunger lift is a type of gas-lift employing a plunger that goes up and down inside the wellbore casing or production tubing. The plunger provides an interface between the liquid phase above the plunger and the lift gas below the plunger to reduce liquid fallback. The plunger lift utilizes reservoir natural energy to lift the accumulated liquid in the wellbore to restore or increase production in liquid-loaded wells. The plunger may be implemented without an external power source to the plunger in embodiments.

Aspects of the present disclosure are generally directed to artificial lift for deliquification in oil wells, gas wells, and oil and gas wells. Some aspects are directed to plunger lift employing an unloading plunger that is gas-charged, such as nitrogen-charged. In particular, the plunger has an internal chamber (hollow portion) that holds (stores) the high-pressure gas, such as nitrogen. The plunger has a jetting port that may be a jetting nozzle or include a jetting nozzle. The jetting port is on a bottom portion of the plunger to discharge (eject) the compressed gas from the chamber to provide a jetting force for lifting the plunger. The plunger has an internal timer that regulates when the compressed gas is released from the internal chamber through the jetting port. A portion of the plunger body may be removable to provide access to adjust the timer. The timer settings may be adjusted, for example, based on the effect of well conditions on the plunger-lift cycle. The time may be adjusted based on the well conditions, depth, production rate, and well configuration.

In operation, the pressurized gas is discharged (ejected) from the internal chamber through the jetting port (ejection port) after the plunger reaches the bottom of the well. The jetting port may be a jetting ejection nozzle or include a jetting ejection nozzle. The unloading plunger may include more than one jetting port. The plunger may discharge the high-pressure gas through the jetting port(s) after the plunger arrives bottomhole to increase propulsion of the plunger for ascent to facilitate lifting the well in loaded conditions. The plunger ascends via gas lift, and by the jetting action (jetting force) provided by the compressed gas discharging through the jetting port(s) from a bottom portion of the plunger. The unloading plunger includes the timer for specifying when to release and discharge the compressed gas. The plunger may discharge the high-pressure gas, e.g., nitrogen (N2), via the timer to propel the plunger as the plunger travels to the surface.

The gas-charged unloading plunger of present embodiments incorporates the internal high-pressure gas chamber and the timer. As indicated, the internal chamber provides for storing pressurized gas that can be discharged. The pressurized gas may be discharged when or after the plunger reaches a bottom portion of the well and also during ascent of the plunger. The plunger may discharge the pressurized gas (e.g., nitrogen) through the plunger jetting port (nozzle) into the lift gas below the plunger. The jetting ports(s) may be designed, for example, to give a desired mass rate or velocity of the discharged pressurized gas to promote ascent of the plunger and lifting the well in loaded conditions. In examples, multiple cycles (plunger lift) may be implemented based on the well unloading conditions. Embodiments may employ plunger lift to unload the wells without swabbing or coiled-tubing intervention in certain implementations. Swabbing and coiled-tubing intervention can add significant cost and operational risk.

In some applications, the present plunger may facilitate kicking off the well without swabbing or coiled tubing intervention to unload the well. Embodiments of the present plunger-lift techniques may also advance utilizing the plunger in depleted reservoirs where the reservoir energy is inadequate to cycle a conventional plunger and where conventional plunger unloading may employ external power. Implementations may expand the operating range of plunger lift in covering depleted and low-pressure wells. Examples may promote producing the wells for longer periods utilizing the reservoir natural energy generally without an external power source for the plunger. Some embodiments can avoid expensive interventions to unload the wells.

FIG. 1 is an unloading plunger 100 that can be utilized in plunger lift applications for gas wells, oil and gas wells, or oil wells. In the illustrated embodiment, the unloading plunger 100 is an intermittent-style plunger, and not a flow-through plunger having an internal bypass valve or internal bypass flow passage.

The unloading plunger 100 has an internal chamber 102 that is an internal (interior) cavity within the body 104 of the unloading plunger 100. The inside surface 108 of the body 104 defines the internal chamber 102. The plunger body 104 may be labeled as a wall of the internal chamber 102. A compressed gas (e.g., nitrogen, air, inert gas, etc.) may be added to the internal chamber 102. In examples, the pressure in the internal chamber 102 with the compressed gas (before release) may be at least 1000 pounds per square inch gauge (psig) or in a range of 1000 psig to 5000 psig. The pressure may be outside of this numerical range.

In operation, the internal chamber 102 may be charged with gas (e.g., nitrogen) each cycle (or most cycles) of the plunger lift. In examples, the unloading plunger 100 may be accessible for injecting gas into the internal chamber 102 at a rest position (e.g., lubricator) at the wellhead in or between cycles. The compressed gas may be added to the unloading plunger 100 in place at the wellhead. On the other hand, the unloading plunger 100 may be removed from the wellhead and the compressed gas introduced, and the unloading plunger 100 placed back in the rest position at the wellhead.

The unloading plunger 100 includes a gas charging port 106 to inject compressed gas into the internal chamber 102. The gas charging port 106 has a passage 108 in the body 104 to provide the compressed gas to an inlet opening 110 of the internal chamber 102 to add the gas to the internal chamber 102. The gas charging port 106 may have, for example, a stem valve or check valve for gas addition to reach the desired internal pressure in the internal chamber 102. In certain implementations, an external valve (not shown) can be employed in combination with the gas charging port 106 to facilitate introduction of the compressed gas into the internal chamber 102.

The unloading plunger 100 includes a gas jetting port 112 (gas ejection port) on a bottom portion of the plunger 100. In operation, the gas jetting port 112 ejects compressed gas to below the plunger 100 to propel the plunger 100 during ascent. The plunger 100 may have multiple gas-jetting ports 112 that operate to eject compressed gas from the internal chamber 102 to below the plunger 100. The gas jetting port 112 has a passage 114 in the body 104 to receive the compressed gas from the discharge opening 116 of the internal chamber 102. The passage 114 may be a conduit installed in the body 104 or a cavity formed in the body 104, and the like. The gas jetting port 112 has an ejection opening 118 at the exterior surface of the body 104 to discharge (eject) the compressed gas to below the plunger 100, as indicated by arrow 120. The passage 114 may be configured as a nozzle (jetting nozzle). In certain embodiments, the gas jetting port 112 may have a nozzle or orifice 122 (e.g., flow orifice, restriction orifice, etc.) as a jetting nozzle disposed in the passage 114. In some embodiments, the combination of the passage 114 and the orifice 122 may be configured in tandem as a jetting nozzle.

The pressure specified for the compressed gas in the internal chamber 102 may be based on or correlative with the volume (or mass) and velocity of the compressed gas (e.g., nitrogen) as ejected to unload a specific well. The pressure specified may be in response to the hydrostatic pressure (height of liquid to unload) above the plunger 100 and the amount of gas-lift pressure below the plunger 100.

The size and geometry of the gas jetting port 114 may generally be considered in determining ejection velocity and volume. The chamber 102 pressure may be specified in combination with size of the gas jetting port 114 to give an adequate amount and velocity of ejected gas during the plunger-lift cycle.

In implementations, the plunger 100 may expend (eject) most or substantially all of the compressed gas from the internal chamber 102 in a cycle. In other words, for those implementations, the internal chamber 102 may generally fully deplete in a single cycle. However, in other implementations, the availability in the chamber 102 of the charged compressed gas may last more than one cycle, such as for shallow wells. The plunger lift in deeper wells may typically rely on charging the plunger 100 with compressed gas every cycle or most cycles.

The plunger 100 has an internal timer-operated valve 124 (with adjustable timer) to maintain the compressed gas in the internal chamber 102 and to release the compressed gas from the internal chamber 102. The timer-operated valve 124 when closed may be in an operating position that blocks the discharge opening 116 of the internal chamber 102, and thus the compressed gas is not released from the chamber 102. Thus, the timer-operated valve 124 in a closed operating position prevents flow of the compressed gas through the discharge opening 116. Conversely, the timer-operated valve 124 when open may be in an operating position that does not block the discharge opening 116, and thus gas may release through the discharge opening 116 from the chamber 102. Therefore, the timer-operated valve 124 in an open operating position may provide flow of the compressed gas from the internal chamber 102 through the discharge opening 116 and through or adjacent the timer-operated valve 124.

The timer-operated valve 124 includes a timer and a valve. The timer may include at least two time settings and may cycle through the time settings in operation. In examples, a first setting is a length of time that the valve is to be in a closed operating position in a cycle. A second setting is a length of time in the cycle that the valve is to be in an open operating position. The user or human operator (or electronic controller) may consider well conditions and other information in determining, specifying, and inputting (entering) the time values to the timer for the time settings. Well conditions considered may include, for example, plunger fall velocity and depth, well shut-in time to build bottomhole pressure, and so forth.

For a user or human operator to access the timer of timer-operated valve 124 to input and adjust the timer settings, the unloading plunger 100 may have a removable portion 126 of the body 104. In the illustrated embodiment, the removable portion 126 is a removable head that is an upper portion of the body 104. In other embodiments, the removable portion 126 may be a bottom portion of the body 104. In one embodiment, the removable portion 126 is a removable side panel of the body 104 on a middle portion of the body 104. Other configurations for the removable portion 126 may be implemented.

In certain embodiments, the removable portion 126 is threaded to the remaining portion of the body 104. Thus, the connection between the removable portion 126 (e.g., removable head) and the remaining portion of the body may be a screwed connection. The interface may include mating threads. The removable portion 126 of the body 104 may have threads that mate with threads on the remaining portion of the body 104.

The timer settings (e.g., initial timer settings) of the timer-operated valve 124 may generally be input and set prior to entry of the unloading plunger 100 into operation of the well system. In implementations, the unloading plunger 100 may be available at a rest position at the wellhead to adjust the timer settings during operation of the well system. The removable portion 126 (removable head) may be unscrewed from the unloading plunger 100 in place at the wellhead for access to the timer. The removable portion 126 may be screwed back onto the unloading plunger 100 at the rest position. On the other hand, the unloading plunger 100 may be retrieved from rest position at the wellhead, and the removable portion 126 unscrewed and the timer settings adjusted. The removable portion 126 may be screwed back onto the unloading plunger 100 and the unloading plunger 100 placed back in the rest position at the wellhead.

The valve of the timer-operated valve 124 may be an on/off valve that operates in an open position or closed position. In examples, the valve may be a ball valve, or a plug or plate, etc. The valve be a plug that inserts into the chamber discharge opening 116 in a closed operating position and is raised from the discharge opening 116 in an open operating position. The valve may be a plate resting on (or pressed on) the discharge opening 116 in a closed operating position and pushed (displaced) to the side (or raised) revealing the discharge opening 116 in an open operating position. Other examples may be implemented. Additional valve types and configurations are applicable.

The timer may be an electronic or digital timer. The unloading plunger 100 may have a battery to provide power (electricity) to the electronic or digital timer. In other implementations, the timer may be a mechanical timer (analog timer, manual timer, etc.) that does not require power (electricity). As is typical, the mechanical timer may utilize clockwork and have a mainspring to run the timer. For instance, the energy in the mainspring may cause a balance wheel to rotate back and forth. Each swing of the wheel may release the gear train to move an indicator or counter by a small fixed amount. Other configurations of a mechanical timer are applicable, as would be appreciated by one of ordinary skill in the art.

The timer can have a valve actuator to drive the valve of the timer-operated valve 124 such as to drive the valve position or valve operating position. As mentioned, the valve may be an on/off valve. In other words, the valve operation position may include, for example, two operating positions of closed and open, respectively. The closed operating position may be fully closed (100% closed). The open operating position may be partially open or fully open (100% open). In operation, the timer may set the operating position of the valve via the actuator per the timer setting and time expired. For a mechanical (analog) timer, the valve actuator may include a spring and/or be spring-wound (or spring-loaded). The actuator may include a rod, bar, pivoted bar, teeth, diaphragm, clamp, latch, catch, wheel, ratchet, ratchet wheel, pivoted tongue, sliding bolt, piston, notches, pawl, shaft, cam, etc. While the timer-operated valve 124 is a unique application, timer-operated valves in general including those with mechanical timers (that do not rely on electrical power or electricity) and their operation are understood by one of ordinary skill in the art.

In one example, the timer is similar to timers utilized for downhole samplers (downhole sampler tool) that are lowered into a wellbore. A downhole sampler tool may be triggered by a timer with a mechanical clock in the tool or by an electric signal conveyed by electric line. More common for downhole samplers is the former—a timer with a mechanical clock in the downhole sampler, and the downhole sampler tool run with a wireline unit.

In one example for the timer-operated valve 124 on the unloading plunger 100 as an analog timer having a mechanical clock, the valve is a plate and the timer valve actuator is spring-loaded to move the plate away from the chamber discharge opening 116 for the open position, and allow the plate to return to the discharge opening 118 in the closed position. In the closed position, the plate may rest on the discharge opening 116 sealing the opening 116 and preventing flow of compressed gas from the internal chamber 102 through the discharge opening 116. To move the plate for the open position, the actuator may raise the plate or push (displace) the plate to the side, revealing (opening) the discharge opening 116 for flow of the compressed gas.

In general for operation for the time-operated valve 124 as open, the compressed gas may flow from the internal chamber 102 through discharge opening 116 and gas jetting port 112 to outside of the unloading plunger 100 below the unloading plunger 100. The jetting port 112 may be sized and the pressure in the internal chamber 102 specified to give a desired volume and velocity of the compressed gas discharged, such as into the gas lift below the plunger 100 in operation. The jetting port 112 characteristics (e.g., flow-passage 114 length and diameter, nozzle orifice diameter, etc.) and the chamber 102 pressure may be specified to give a desired velocity or amount (rate) of the compressed gas ejected. The sizing of the nozzle orifice may be based on or correlative with, or in response to, (1) the well depth and height (and weight) of the expected liquid column to be unloaded and (2) the bottomhole pressure on which the plunger 100 and unloading operation can rely.

In operation, the discharge of the compressed gas through the jetting port 112 from the bottom portion of the plunger 100 may facilitate the plunger 100 to ascend. The plunger 100 may be lifted in part by underlying well pressure. The gas discharge through the jetting port 112 may provide additional propulsion for the plunger 100 to promote unloading the well with less or reduced bottomhole well pressure. The ejection of the compressed gas (e.g., nitrogen) from the jetting port 112 advances the lift (unloading the well) by providing a jetting or jetting force to overcome hydrostatic pressure above the plunger 100.

The unloading plunger 100 as employed in plunger lift may provide to produce wells for longer periods utilizing the reservoir natural energy because in operation the ejection of gas through the jetting port 112 provides additional lift (for the plunger 100 and the liquid above the plunger) and thus less reservoir pressure (bottomhole pressure) is needed to ascend the plunger and unload the well. The unloading plunger 100 may extend the operating envelop of plunger lift to cover depleted wells with lower energy. Moreover, for startup and commissioning cases, the unloading plunger 100 may permit to avoid swabbing or coiled tubing intervention for kick off the well and allow plunger lift to operate. Typical wells loaded prior to plunger installation may require expensive slickline swabbing or coiled tubing intervention to kick off the well. However, the unloading plunger 100 and associated present techniques may facilitate unloading such a well via multiple cycles without the swabbing or coil tubing intervention in certain instances.

Figure 2:
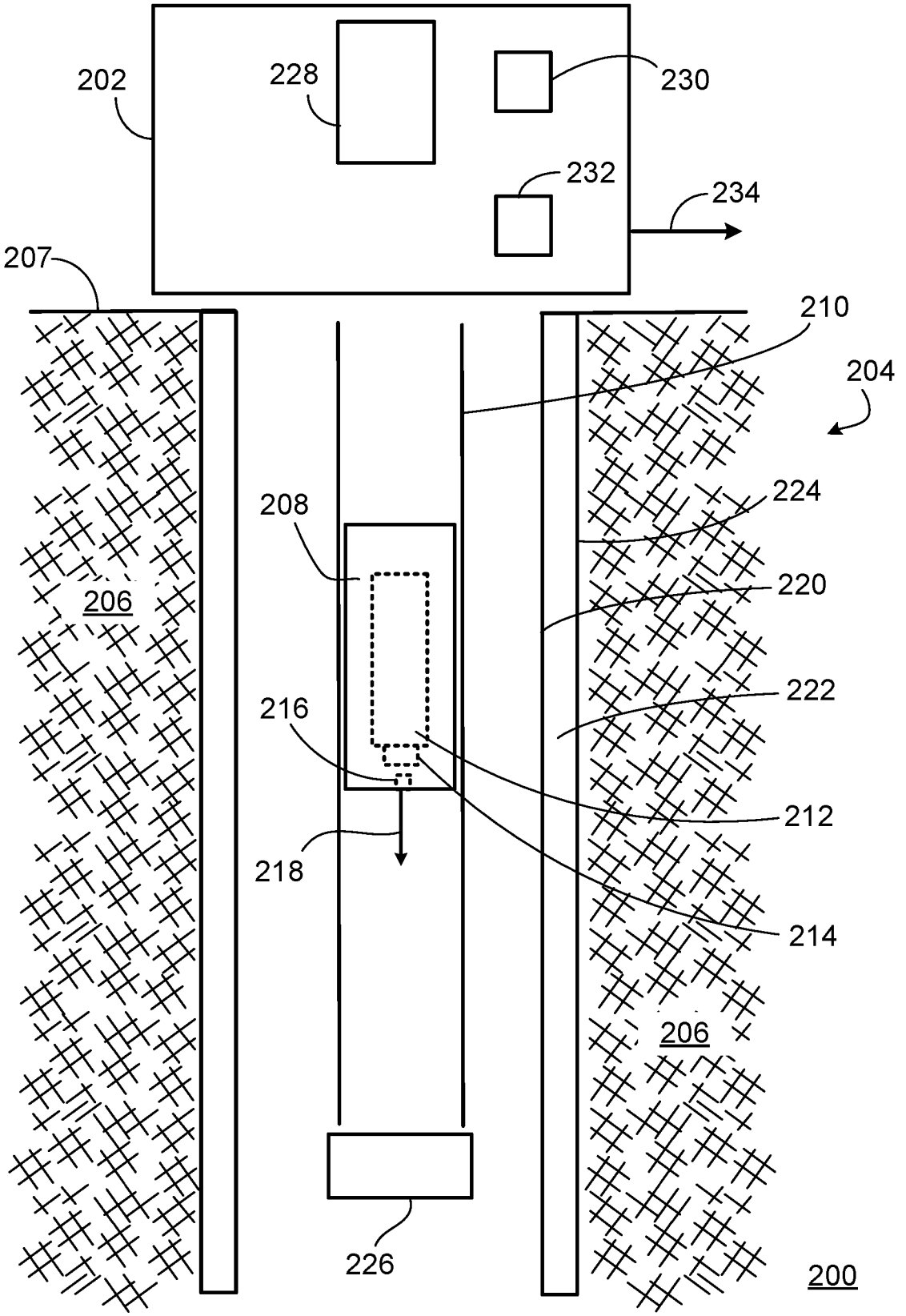
FIG. 2 is a diagram of a well having a wellhead and a wellbore in a subterranean formation.

FIG. 2 is a well 200 having a wellhead 202 and a wellbore 204 in a subterranean formation 206. The wellbore 204 is formed through the Earth surface 207 into the subterranean formation 206.

An unloading plunger 208 is depicted in production tubing 210 in the wellbore 204. The unloading plunger 208 may be analogous to the unloading plunger 100 of FIG. 1. As depicted, the unloading plunger 208 may be descending or ascending in the production tubing 210 in an unloading operation. The unloading plunger 208 includes an internal chamber 212 having compressed gas, such as compressed nitrogen. The unloading plunger 208 includes a timer-operated valve 214 to maintain the compressed gas in the internal chamber 212 and to release the compressed gas from the internal chamber 212. The compressed gas may be released per the timer-operated valve 214 from the internal chamber 212 through the gas jetting port 216 (gas ejection port) on a bottom portion of the unloading plunger 208. The compressed gas may discharge (eject) via the gas jetting port 216 into the production tubing 210 below the unloading plunger 208, as indicated by arrow 218. The timer-operator valve 214 is generally closed and the compressed gas not release while the unloading plunger is descending in the production tubing 210. The timer-operator valve 214 is generally open and the compressed gas thus released while the unloading plunger is ascending in the production tubing 210.

In the illustrated implementation, the wellbore 204 is a cemented cased wellbore. The wellbore 204 includes a casing 220 with cement 222 in the annulus between the casing 204 and the face 224 (surface) of the subterranean formation 206. The wellbore 204 may have casing perforations through the casing 204 and cement 222 into the subterranean formation 206. The casing perforations (not shown) may provide for flow of produced hydrocarbon from the subterranean formation 206 into the wellbore 204. A bottomhole bumper 226 may be disposed in a bottom portion (bottomhole) of the wellbore 204. The bottomhole bumper 226 may have a spring. Thus, the bottomhole bumper 226 may be labeled as a bottomhole bumper spring. Moreover, while the unloading plunger 208 is depicted in the production tubing 210, other embodiments may employ an unloading plunger 208 in the wellbore 208 as interfaced with the casing 220 in sections of the wellbore 204 without production tubing 210.

The wellhead 202 may include a rest position 228 for the unloading plunger 208. In embodiments, the rest position 228 is on an upper portion of the wellhead 202. The rest position 224 may be a receptacle to receive the unloading plunger 208. In implementations, the rest position 224 is a lubricator. The lubricator is a conduit (pipe or tubing) and thus may be labeled as a lubricator pipe or lubricator tubing. In some examples, the lubricator may generally have the same inner diameter as the production tubing 210. The lubricator as a lubricator conduit may provide a hollow receptacle to receive the unloading plunger 208. The lubricator may include a spring (e.g., shock spring, bumper spring, etc.) to lessen the impact of the unloading plunger 208 when received at the lubricator (rest position 228). The rest position 228 (e.g., lubricator) may include an arrival sensor to detect receipt of the unloading plunger 208. A signal indicative of the receipt may be transmitted from the sensor to a controller 230 or other controller. The controller 230 may have a hardware processor and memory (e.g., volatile and/or nonvolatile) storing code (e.g., instructions, logic, etc.) executed by the processor. The lubricator as a rest position 224 may include a plunger catch or plunger catcher, as appreciated by the skilled artisan. The plunger catch (along with well pressure) may retain the unloading plunger 208 in the lubricator and be adjusted to release (drop) the unloading plunger 208 from the lubricator back into the production tubing 210. The lubricator with catcher may be an assembly and thus labeled as a lubricator/catcher assembly. The unloading plunger 208 at the rest position 224 may be accessible for charging gas to the inlet chamber 212, adjusting the timer on the timer-operated valve 214, and so on.

The wellhead 202 may include a production valve 232 (e.g., sales valve) for the flow (discharge) of produced hydrocarbon, such as crude oil or natural gas, or both. The hydrocarbon may flow from the production tubing 210 through the wellhead 202 and production valve 232 into a discharge conduit 234 (e.g., sales line). In embodiments, the production valve 232 may be a motor operated valve (MOV). The controller 230 or other controller may be a valve controller for the production valve 232.

In operation for some embodiments when the well 200 is under liquid-loading conditions and producing little or no hydrocarbon, the unloading plunger 208 may descend (e.g., via gravity) from the rest position 228 to the bottomhole bumper 226 without shut-in of the wellbore 204. Even though wellbore 204 pressure is inadequate to unload the well 200, the jetting action of the unloading plunger 208 in combination with the wellbore 204 lift pressure that does exist provides for lifting the well 200. The plunger 208 jetting action provides additional motive force (head) to overcome the hydrostatic pressure to displace the liquid above the plunger 208 through the wellhead 202.

In other embodiments when the well 200 is liquid-loaded, the well 200 in a loaded condition may be shut-in to increase pressure in the wellbore 204. The wellbore 204 may be shut-in by closing the production valve 232 (and manual valves) at the wellhead 202. The unloading plunger 208 may release from the rest position 228 and descend through the production tubing 210 to the bottomhole bumper 226 below the liquid level in the production tubing 210. Because the well 200 (wellbore 204) is shut in, the wellbore 204 pressure will increase and may reach an adequate lift pressure for the unloading plunger 208 to ascend. Advantageously, the wellbore 204 shut-in time may be less than with a conventional plunger because the jetting action of the unloading plunger 208 will provide additional lift and thus the plunger lift can employ lower bottomhole pressure (and therefore less wellbore 204 shut-in time is realized). In some implementations, the unloading plunger 208 at bottomhole (and prior to ascent) may discharge 218 the compressed gas to facilitate start (initiate) the lift at lower bottomhole pressures. The timer-operated valve 214 may open to release gas from the internal chamber 212 and discharge the compressed gas through the gas jetting port 216 into the wellbore 204 below the plunger 208, as indicated by arrow 218. The compressed gas may be ejected prior to the plunger 208 ascending and while the plunger 208 is ascending.

The production valve 232 (if closed) at the wellhead 202 may be opened for the unloading and for the unloading plunger 208 to begin ascending in the production tubing 210 via the existing underlying lift and plunger 208 jetting force. The existing underlying lift may be the built-up pressure in the wellbore 204 from formation 206 pressure (e.g., near wellbore). As mentioned, the timer-operated valve 214 may be open before and during the ascent of the unloading plunger 208 to release the compressed gas from the internal chamber 212 for the jetting action (force). The compressed gas discharges (ejects) 218 through the gas jetting port 216 into the fluid in the production tubing 210 below the ascending unloading plunger 208 to provide additional motive head (to overcome the hydrostatic head of the liquid). As discussed, such may make unloading feasible for lower existing lift pressures (lower bottomhole pressures).

As the unloading plunger 208 approaches the wellhead 202, the liquid (e.g., condensate, water, oil, etc.) above the ascending plunger 208 flows through the production valve 232 into the discharge conduit 234 and is thus unloaded from the well 200. The timer-operated valve 214 may close when the plunger 208 reaches surface 207. The plunger 208 reaches the rest position 228. With the well 200 unloaded, hydrocarbon (e.g., natural gas or crude oil, or both) may be produced from the subterranean formation 206. The produced hydrocarbon may flow through the production valve 232 and into the discharge conduit 234 (e.g., sales line). When the well 200 becomes loaded again with liquid, the well 200 including wellbore 204 may be optionally shut in and the plunger 208 descended to the bottom hole to start the cycle again.

There may be at least two flow periods in the plunger lift cycle: (1) unloading flow through the production valve 232 while the plunger 208 is ascending; and (2) flow (after flow) of production by the unloaded well 200 after the plunger 208 reaches the wellhead 202. During the after-flow period in some implementations, the internal chamber 212 of the plunger 208 at the rest position 228 may be recharged with compressed gas. Also, the timing of the timer-operated valve 214 may be adjusted if desired during the after-flow period. The timing may be adjusted in response to changing well 200 conditions or based on a better understanding of the well 200 conditions, and the like.

The timer may include a first setting that is the length of time (interval) the timer-operated valve 214 is closed and a second setting that is the length of time (interval) the timer-operated valve 212 is open. The length of time for the timer-operated valve 214 to be closed in a cycle may include the combined time of (a) time for the plunger 208 to descend, (b) a first portion of the time the plunger 208 is at bottomhole, and (c) the after-flow time of production. The length of time for the timer-operated valve 214 to be open may include the combined time of (a) a second portion of time the plunger 208 is at bottom hole and (b) the time for the plunger 208 to ascend through the production tubing 210.

Benefits of the present unloading plunger may include increased operating range of plunger lift systems and also advanced plunger lift in low GLR wells. An advantage may be avoiding swabbing or coiled tubing intervention to unload a well in some embodiments. Further, the present unloading plunger may promote lifting more liquids in plunger lift, increase utilization of the reservoir natural energy, and increase time of producing wells while avoiding an external power source for the plunger in certain implementations.

Referring to FIG. 1 and FIG. 2, an embodiment is an unloading plunger (e.g., 100, 208) to unload liquid from a well (e.g., 200). The unloading plunger includes a body (e.g., 204) (e.g., a steel body) to interface with an inside surface of production tubing (e.g., 210) in a wellbore (e.g., 204) to provide a seal in the production tubing between above the unloading plunger and below the unloading plunger. The seal may seal the fluid (e.g., liquid) in the production tubing above the unloading plunger from the fluid (e.g., gas) in the production tubing below the unloading plunger. The unloading plunger includes an internal chamber (e.g., 102, 212) to hold a compressed gas (e.g., nitrogen). The compressed gas may be at a pressure of at least 1000 psig in the internal chamber prior to discharge of the compressed gas from the unloading plunger. The unloading chamber has a gas charging port (injection port) (e.g., 106) to receive the compressed gas into the internal chamber and a gas jetting port (e.g., 112) to eject the compressed gas from the internal chamber.

The internal chamber has a chamber inlet (e.g., 110) to receive the compressed gas into the internal chamber. The plunger body has the gas charging port (e.g., 206) to receive and provide the compressed gas to the chamber inlet. The internal chamber has a chamber outlet to release the compressed gas from the internal chamber. The unloading plunger has the gas jetting port in the body at a bottom portion of the unloading plunger to receive the compressed gas from the internal chamber through the chamber outlet. The gas jetting port discharges the compressed gas to below the unloading plunger as a jetting force for the unloading plunger. The jetting force may provide a motive force for ascent of the unloading plunger in the production tubing. The gas jetting port is configured to discharge (e.g., 120, 218) the compressed gas to below the unloading plunger in the production tubing.

The unloading plunger has a timer-operated valve (e.g., 124, 214) disposed at the chamber outlet to prevent flow of the compressed gas through the chamber outlet when the timer-operated valve is closed and to provide release of the compressed gas through the chamber outlet from the internal chamber when the timer-operated valve is open. The timer-operated valve may include a timer to direct operating position of a valve of the timer-operated valve. In particular implementations, valve includes a plate to prevent release of the compressed gas through the chamber outlet when the timer-operated valve is closed. The timer-operated valve has a first time setting that is length of time the timer-operated valve is closed in a cycle. The timer-operated valve has a second time setting that is length of time the timer-operated valve is open in the cycle. The plunger body may have a removable head to provide access to the timer-operated valve to set timing of the timer-operated valve. In implementations the timer-operated valve has a mechanical timer that does not receive electricity in operation. In certain implementations, the timer-operated valve includes the mechanical timer having an actuator to operate a valve of the timer-operated valve.

Figure 3:
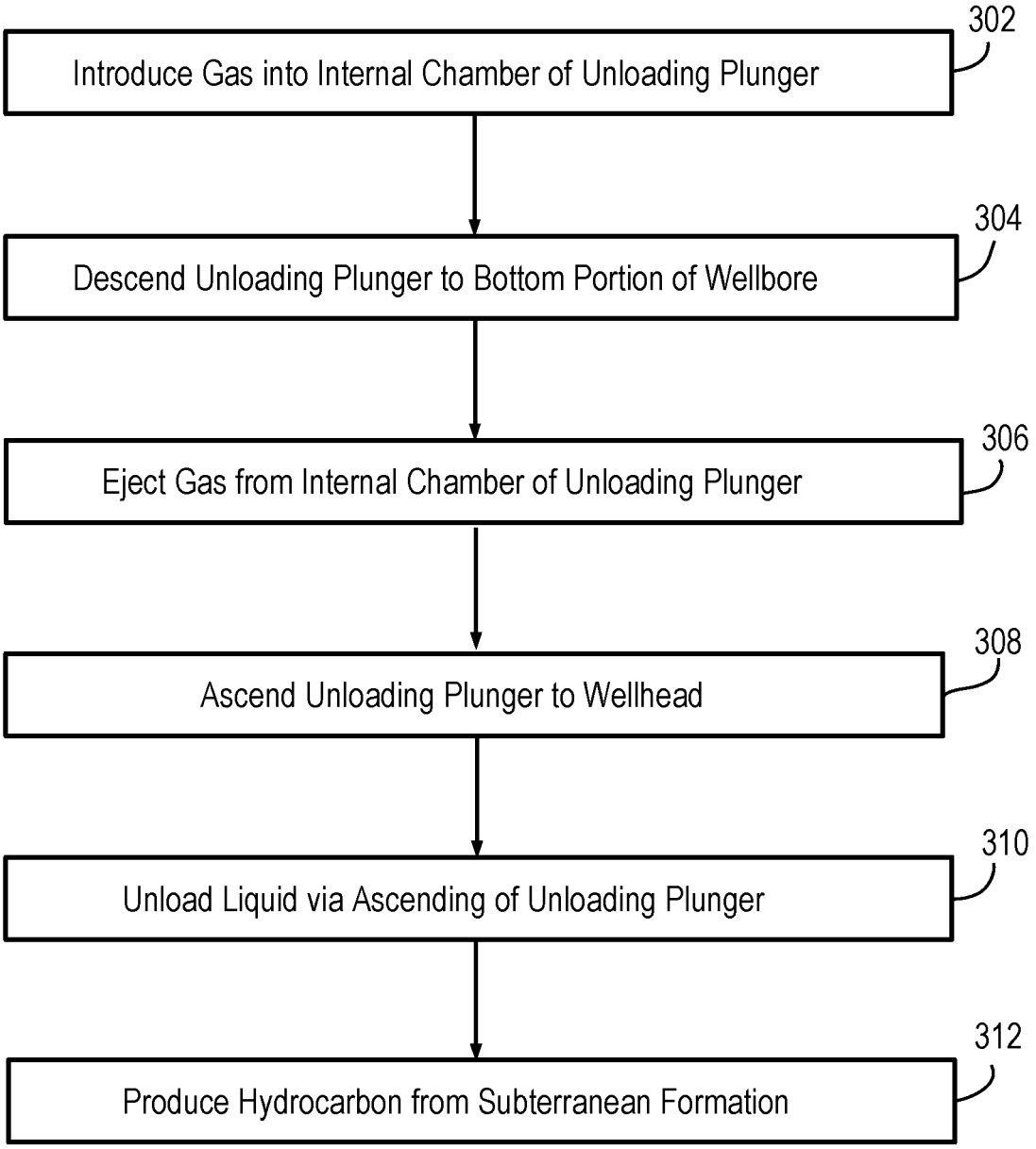
FIG. 3 is a block flow diagram of a method of operating a well.

FIG. 3 is a method of operating a well. The well may be a well that produces hydrocarbon from a subterranean formation. The hydrocarbon may be natural gas or crude oil, or both. The well has a wellhead operationally coupled with a wellbore in the subterranean formation. The method involves an unloading plunger having an internal chamber. The internal chamber may be an internal cavity of the body of the unloading plunger.

At block 302, the method includes introducing compressed gas (e.g., compressed nitrogen) into the internal chamber via a gas charging port of the unloading plunger. In implementations, the internal chamber is charged to a pressure of at least 1000 psig with the compressed gas. In examples, the unloading plunger may be available to receive the compressed gas while at the rest position at the wellhead discussed below. The internal chamber may be charged with compressed gas every cycle (or most cycles) of the plunger lift operation.

At block 304, the method includes descending (e.g., via gravity) the unloading plunger from the rest position (e.g., lubricator pipe) at the wellhead into production tubing to below liquid in the production tubing in a bottom portion of the wellbore. The descending to below liquid in the production tubing may include descending to bottomhole of the wellbore, such as to a bottomhole bumper. The unloading plunger may provide a seal in the production tubing between the liquid above the unloading plunger and fluid below the unloading plunger.

At block 306, the method includes ejecting the compressed gas from the internal chamber. The compressed gas may be released through the chamber discharge opening and discharge through a gas jetting port of the unloading plunger. The compressed gas may eject into the production tubing below the unloading plunger to provide motive force for ascent of the unloading plunger through the production tubing to the wellhead. The compressed gas may discharge from the internal chamber from a bottom portion of the unloading plunger.

At block 308, the method includes ascending the unloading plunger through the production tubing from the bottom portion of the wellbore to the rest position at the wellhead via a combined motive force. The combined motive force includes a combination of at least a first motive force and a second motive force. The first motive force is wellbore pressure provided by formation pressure of the subterranean formation. The second motive force is the motive force provided by ejecting the compressed gas.

At block 310, the method includes unloading the liquid above the unloading plunger in the production tubing via the ascending of the unloading plunger. The unloading may include discharging the liquid from the production tubing through a production valve at the wellhead, such as into a sales line.

At block 312, the method includes producing hydrocarbon from the subterranean formation through the production tubing and the production valve at the wellhead after unloading the liquid in the production tubing above the unloading plunger. The production flow may be characterized as an after flow with respect to the plunger lift cycle. The wellbore may have casing having perforations for introduction of the hydrocarbon from the subterranean formation into the wellbore. As mentioned, the hydrocarbon may include natural gas or crude oil, or both.

To increase wellbore pressure provided by the formation pressure as desired in the plunger lift cycle, the method may include placing the wellbore as shut-in prior to ejecting the compressed gas and prior to ascending the unloading plunger. The placing of the wellbore as shut-in may involve closing the production valve at the wellhead to stop flow of fluid from the production tubing through the production valve. The shut-in of the wellbore gradually increases the wellbore pressure provided by the formation pressure. The wellbore is generally not shut-in during ejecting of the compressed gas and the ascending of the unloading plunger.

The unloading plunger may have a timer-operated valve including a timer and a valve. The timer may direct operating position of the valve. The timer-operated valve may be disposed at the chamber discharge opening of the internal chamber. The valve of the timer-operated valve in a closed operating position may prevent the releasing of the compressed gas from the internal chamber through the chamber discharge opening. Conversely, the valve in an open operating position may permit the releasing of the compressed gas from the internal chamber through the chamber discharge opening. The method 300 may include maintaining the valve (of the timer-operated valve) closed via the timer during the descending (block 302) of the unloading plunger, and maintaining the valve open via the timer during the ascending (block 306) of the unloading plunger. The method may include inputting a first time setting to the timer that is length of time the timer maintains the valve closed in a cycle, and inputting a second time setting to the timer that is length of time the timer maintains the valve open in the cycle. The inputting of the first time setting and the second time may involve removing a head of a body of the unloading plunger to access the timer. The unloading plunger may be available for such assed wherein the unloading plunger is at the rest position at the wellhead. In some implementations, the timer includes a mechanical timer having an actuator to operate the valve, wherein the mechanical timer does not receive electricity in operation. In particular implementations, the valve includes or is a plate that prevents release of the compressed gas through the chamber discharge opening when the valve is in a closed operating position.

As indicated, plunger lift is typically used in high GLR gas and oil wells, but is versatile to be utilized in lower GLR wells as well. The GLR is the ratio of produced gas volume to total produced liquids (oil and water) volume. As with other artificial lift methods, the purpose of plunger lift may be to remove liquids from the wellbore so that the well can be produced at lower (e.g., the lowest) bottom-hole pressure and increased (e.g., maximum) rate. A plunger lift system may rely directly on the natural buildup of pressure in a shut-in gas well and gas velocity. In examples, the plunger cycle may start on top of the bottom-hole bumper spring or in the surface lubricator. When the well is shut-in the plunger falls through the gas and liquid to the bottom-hole bumper spring. When the well is opened up, the plunger travels from the bottom-hole bumper spring to the surface. The controller opens a motor valve (production valve) at the surface and the well's shut-in pressure creates a differential pressure that forces the plunger interface up and lifts the liquid to surface. An arrival sensor (if present) recognizes the plunger arrival. The plunger provides a seal between the liquid above and the gas below, such that the well energy is used to lift liquids out of the wellbore.

Plunger lift utilizes the plunger as a piston that travels up and down in the well tubing string. It prevents or reduces liquid fallback and relies on well energy generally more efficiently than do slug or bubble flow. As with other artificial-lift methods, the purpose of plunger lift is to remove liquids from the wellbore so that the well can be produced at the lower bottomhole pressures, as mentioned. Whether in a gas well or oil well, the plunger lift may generally be the same or similar. As discussed, the plunger (e.g., a length of steel) is dropped through the tubing to the bottom of the well and allowed to travel back to the surface. The plunger provides a piston-like interface between liquids and gas in the wellbore and prevents or reduces liquid fallback. Liquid fallback may be characterized as a part of the liquid load that effectively is lost because the liquid fallback is left behind. Again, because the plunger provides a seal between the liquid above and the gas below, the well energy can be used to lift liquids out of the wellbore.

The plunger operation may generally consist of shut-in and flow periods. The flow periods may be divided into at least periods of (1) unloading and (2) flow after plunger arrival. The lengths of these periods vary with application, producing capability of the well, and pressures. A plunger cycle may start with the shut-in period that allows the plunger to drop from the surface to the bottom of the well. At the same time, the well builds fluid (gas) pressure. The well should be shut in for an adequate time to build sufficient reservoir pressure to provide energy to lift both the plunger and liquid slug to the surface against line pressure (sales line) and friction of the sales line. When this summative pressure has been reached by the bottomhole lift pressure, the flow period may be started and unloading begins. In the initial stages of the flow period, the plunger and liquid slug begin traveling to the surface. Gas above the plunger flows from the tubing into the production sales conduit, and the plunger and liquid slug follow. The plunger arrives at the surface, unloading the liquid. The well now can produce generally free of liquids, while the plunger is held at the surface (e.g., by well pressure and flow). As hydrocarbon-production rates drop, so do velocities. Eventually, velocities drop below the critical rate, and liquids begin to accumulate in the tubing. The well is shut in, and the plunger falls back to bottom to repeat the cycle.

A number of implementations have been described. Nevertheless, it will be understood that various modifications may be made without departing from the spirit and scope of the disclosure.

What is claimed is:

1. An unloading plunger to unload liquid from a well, the unloading plunger comprising:

a body comprising a wall forming a hollow portion of the body to receive and hold compressed gas at Earth surface external to a wellbore and to hold and discharge the compressed gas in the wellbore, wherein the wall comprises:

a radial outside surface to interface with an inside surface of production tubing in the wellbore to provide a seal in the production tubing between above the unloading plunger and below the unloading plunger;

an inside surface defining the hollow portion as an internal chamber of the body to hold the compressed gas, wherein the internal chamber is an internal cavity within the body; an inlet passage through the wall to receive at the Earth surface the compressed gas into the internal chamber from external of the unloading plunger, wherein the internal chamber comprises a chamber inlet in the wall to receive the compressed gas from the inlet passage into the internal chamber; and an outlet passage through a bottom portion of the wall for discharge of the compressed gas from the internal chamber at a bottom outside surface of the wall, wherein the internal chamber comprises a chamber outlet in the wall to discharge the compressed gas from the internal chamber into the outlet passage;

a gas jetting port comprising the outlet passage in the body at the bottom portion of the unloading plunger to discharge the compressed gas from the unloading plunger at the bottom outside surface of the wall to below the unloading plunger as a jetting force for the unloading plunger; and a timer-operated valve to prevent flow of the compressed gas through the outlet passage when the timer-operated valve is closed and to allow for discharge of the compressed gas through the outlet passage from the internal chamber when the timer-operated valve is open, wherein the timer-operated valve comprises a mechanical timer comprising an actuator to operate a valve of the timer-operated valve, and wherein the timer-operated valve does not receive electricity in operation.

2. The unloading plunger of claim 1, wherein the wall comprises an upper outside surface to contact liquid in the production tubing to unload the liquid from the well, wherein the outlet passage does not comprise the inlet passage, wherein the timer-operated valve comprises a timer to direct operating position of a valve of the timer-operated valve, wherein the gas jetting port comprises a nozzle or orifice, wherein the gas jetting port to discharge the compressed gas to below the unloading plunger in the production tubing, and wherein the jetting force to provide motive force for ascent of the unloading plunger in the production tubing.

3. The unloading plunger of claim 1, wherein the internal chamber to hold the compressed gas at a pressure in a range of 1000 pounds per square inch gauge (psig) to 5000 psig prior to discharge of the compressed gas from the unloading plunger, wherein the compressed gas comprises nitrogen, and wherein the body comprises steel.

4. The unloading plunger of claim 1, wherein the body comprises a gas charging port comprising the inlet passage to receive at the Earth surface the compressed gas from external of the unloading plunger into the internal chamber, and wherein the seal to seal fluid in the production tubing above the unloading plunger from fluid in the production tubing below the unloading plunger.

5. The unloading plunger of claim 1, wherein the internal chamber to receive the compressed gas through the inlet passage from external of the body and hold the compressed gas at a pressure in a range of 1000 psig to 5000 psig at the Earth surface external to the wellbore, wherein the unloading plunger is configured to discharge, via the gas jetting port, the compressed gas held at the Earth surface in the wellbore, wherein the timer-operated valve comprises a first time setting that is length of time the timer-operated valve is closed in a cycle, and wherein the timer-operated valve comprises a second time setting that is length of time the timer-operated valve is open in the cycle.

6. The unloading plunger of claim 1, wherein the internal chamber comprises a chamber outlet in the wall to provide the compressed gas from the internal chamber to the outlet passage, wherein the timer-operated valve comprises the valve disposed at the chamber outlet, and wherein the body comprises a removable head to provide access to the timer-operated valve to set timing of the timer-operated valve.

7. The unloading plunger of claim 1, wherein the inlet passage is through an upper portion of the wall, wherein the timer-operated valve comprises the mechanical timer to direct operating position of the valve of the timer-operated valve, wherein the valve comprises a plate to prevent release of the compressed gas through the outlet passage when the timer-operated valve is closed.

8. A method of operating a well, comprising:

charging at Earth surface external to a wellbore an internal chamber of an unloading plunger with compressed gas received from external of the unloading plunger and holding the compressed gas in the internal chamber at the Earth surface before descending the unloading plunger into the wellbore;

descending the unloading plunger from a rest position at a wellhead into production tubing to below liquid in the production tubing in a bottom portion of the wellbore, the unloading plunger comprising the internal chamber having the compressed gas;

ejecting the compressed gas from the internal chamber into the production tubing below the unloading plunger to provide motive force for ascent of the unloading plunger through the production tubing from the bottom portion of the wellbore to the wellhead, wherein the unloading plunger comprises a timer-operated valve disposed at a chamber discharge opening of the internal chamber, the timer-operated valve comprising a mechanical timer and a valve, wherein the mechanical timer comprises an actuator to operate the valve, and wherein the mechanical timer does not receive electricity in operation;

ascending the unloading plunger through the production tubing from the bottom portion of the wellbore to the rest position at the wellhead via a combined motive force comprising a first motive force comprising wellbore pressure provided by formation pressure and a second motive force comprising the motive force provided by ejecting the compressed gas; and unloading the liquid above the unloading plunger in the production tubing via the ascending of the unloading plunger.

9. The method of claim 8, wherein the unloading plunger provides a seal in the production tubing between the liquid above the unloading plunger and fluid below the unloading plunger, and wherein descending to below liquid in the production tubing in the bottom portion of the wellbore comprises descending to bottomhole of the wellbore.

10. The method of claim 8, wherein unloading the liquid in the production tubing above the unloading plunger via the ascending of the unloading plunger comprises discharging the liquid from the production tubing through a production valve at the wellhead.

11. The method of claim 8, comprising producing hydrocarbon from a subterranean formation through the production tubing and a production valve at the wellhead after unloading the liquid in the production tubing above the unloading plunger.

12. The method of claim 8, wherein holding the compressed gas comprises holding the compressed gas in the internal chamber at a pressure in a range of 1000 pounds per square inch gauge (psig) to 5000 psig at the Earth surface, and wherein the wellbore comprises casing having perforations for introduction of the hydrocarbon from the subterranean formation into the wellbore, and wherein the hydrocarbon comprises natural gas or crude oil, or both.

13. The method of claim 8, wherein the wellbore is not shut-in during the ascending of the unloading plunger, wherein the rest position comprises a wellhead lubricator pipe, and wherein the compressed gas comprises nitrogen.

14. The method of claim 8, comprising placing the wellbore as shut-in to increase the wellbore pressure provided by the formation pressure prior to ejecting the compressed gas and prior to ascending the unloading plunger.

15. The method of claim 14, wherein placing the wellbore as shut-in comprises closing a production valve at the wellhead to stop flow of fluid from the production tubing through the production valve, and wherein the shut-in of the wellbore increases the wellbore pressure provided by the formation pressure.

16. The method of claim 8, wherein descending the unloading plunger through the production tubing comprises descending the unloading plunger through the production tubing to a bottomhole bumper.

17. The method of claim 8, wherein ejecting the compressed gas comprises discharging the compressed gas from a bottom portion of the unloading plunger, and wherein the internal chamber comprises an internal cavity of a body of the unloading plunger.

18. The method of claim 8, wherein ejecting the compressed gas comprises discharging the compressed gas from the internal chamber through a gas jetting port of the unloading plunger.

19. The method of claim 8, wherein ejecting the compressed gas from the internal chamber comprises releasing the compressed gas from the internal chamber though the chamber discharge opening.

20. The method of claim 19, wherein the valve in a closed operating position prevents the releasing of the compressed gas from the internal chamber through the chamber discharge opening, and wherein the valve in an open operating position permits the releasing of the compressed gas from the internal chamber through the chamber discharge opening.

21. The method of claim 8, wherein the unloading plunger comprises a gas jetting port at a bottom portion of the unloading plunger to receive the compressed gas from the chamber discharge opening, and wherein ejecting the compressed gas comprises discharging the compressed gas through the gas jetting port.

22. The method of claim 8, comprising maintaining the valve closed via the mechanical timer during the descending of the unloading plunger, and maintaining the valve open via the mechanical timer during the ascending of the unloading plunger.

23. The method of claim 8, comprising inputting a first time setting to the mechanical timer that is length of time the mechanical timer maintains the valve closed in a cycle, and inputting a second time setting to the mechanical timer that is length of time the mechanical timer maintains the valve open in the cycle.

24. The method of claim 23, wherein inputting the first time setting and the second time setting comprises removing a head of a body of the unloading plunger to access the timer, wherein the unloading plunger is available from the rest position at the wellhead.

25. The method of claim 8, wherein the mechanical timer directs operating position of the valve, wherein the valve comprises a plate that prevents release of the compressed gas through the chamber discharge opening when the valve is in a closed operating position.

26. The method of claim 8, wherein charging the internal chamber at the Earth surface comprises introducing the compressed gas into the internal chamber via a gas charging port of the unloading plunger as available at the rest position at the wellhead, wherein the compressed gas comprises a pressure in a range of 1000 pounds per square inch gauge (psig) to 5000 psig in the internal chamber at the Earth surface and before ejecting the compressed gas from the internal chamber in the wellbore.

* * * * *